US007568777B2

(12) United States Patent
Clark

(10) Patent No.: US 7,568,777 B2
(45) Date of Patent: Aug. 4, 2009

(54) ALTERING FIRING ORDER

(75) Inventor: Garrett E. Clark, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 188 days.

(21) Appl. No.: 11/830,127

(22) Filed: Jul. 30, 2007

(65) Prior Publication Data

US 2009/0033702 A1 Feb. 5, 2009

(51) Int. Cl.
*B41J 29/38* (2006.01)

(52) U.S. Cl. ..... 347/14; 347/57

(58) Field of Classification Search ..... 347/9–12, 347/14, 19, 57, 15, 43
See application file for complete search history.

(56) References Cited

U.S. PATENT DOCUMENTS 4,578,687 A 3/1986 Cloutier et al.
5,648,805 A 7/1997 Keefe et al.
5,648,806 A 7/1997 Steinfield et al.
6,257,690 B1 7/2001 Holstun
6,302,505 B1 10/2001 Askeland et al.
6,305,781 B1 * 10/2001 Hull ..... 347/40
6,318,828 B1 11/2001 Barbour et al.
6,318,832 B1 11/2001 Bates et al.
6,478,396 B1 11/2002 Schloeman et al.
6,543,879 B1 4/2003 Feinn et al.
6,547,354 B1 4/2003 Askeland et al.
6,561,632 B2 5/2003 Feinn et al.
6,629,747 B1 * 10/2003 King et al. ..... 347/19
6,644,782 B1 11/2003 Ward et al.
6,866,364 B2 3/2005 Torgerson et al.
7,032,987 B2 4/2006 Bhattacharjya et al.
2002/0186265 A1 12/2002 Schloeman et al.
2006/0132517 A1 6/2006 Vinas

OTHER PUBLICATIONS

International Search Report for Application No. PCT/US2008/071339. Report issued Feb. 10, 2009.

* cited by examiner

*Primary Examiner*—Thinh H Nguyen

(57) ABSTRACT

Embodiments of altering nozzle firing order are disclosed.

19 Claims, 7 Drawing Sheets

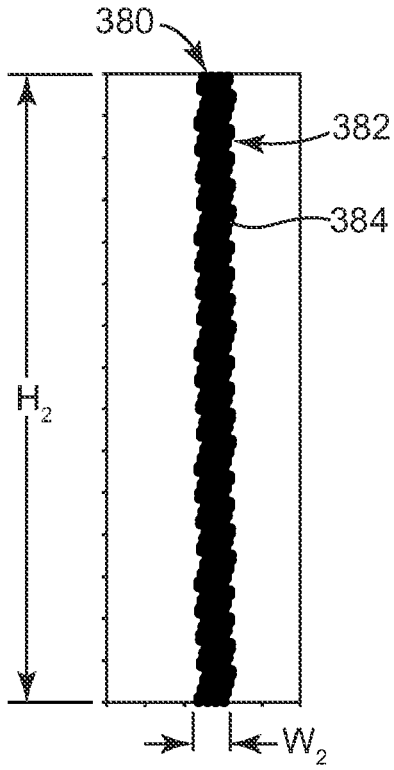
Fig. 7A
390
| OFFSET | | Ø |
|---|---|---|
| I | A | B |
| 1 | 1 | 1 |
| 2 | 5 | 5 |
| 3 | 9 | 9 |
| 4 | 13 | 13 |
| 5 | 4 | 4 |
| 6 | 8 | 8 |
| 7 | 12 | 12 |
| 8 | 3 | 3 |
| 9 | 7 | 7 |
| 10 | 11 | 11 |
| 11 | 2 | 2 |
| 12 | 6 | 6 |
| 13 | 10 | 10 |
Fig. 7B
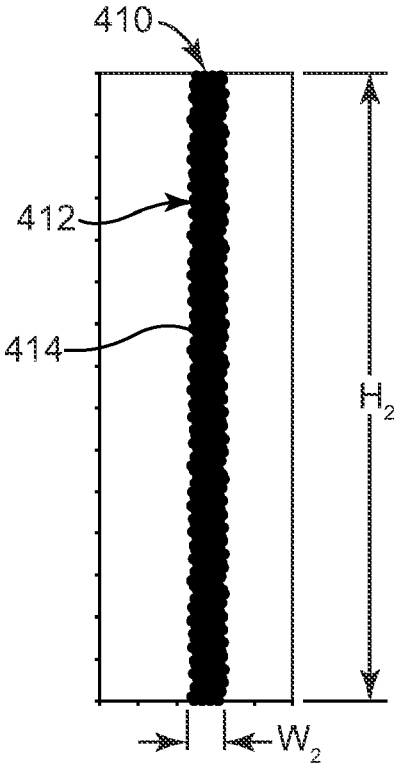
Fig. 8A
420
| OFFSET | | 4 |
|---|---|---|
| I | A | B |
| 1 | 1 | 4 |
| 2 | 5 | 8 |
| 3 | 9 | 12 |
| 4 | 13 | 3 |
| 5 | 4 | 7 |
| 6 | 8 | 11 |
| 7 | 12 | 2 |
| 8 | 3 | 6 |
| 9 | 7 | 10 |
| 10 | 11 | 1 |
| 11 | 2 | 5 |
| 12 | 6 | 9 |
| 13 | 10 | 13 |
Fig. 8B

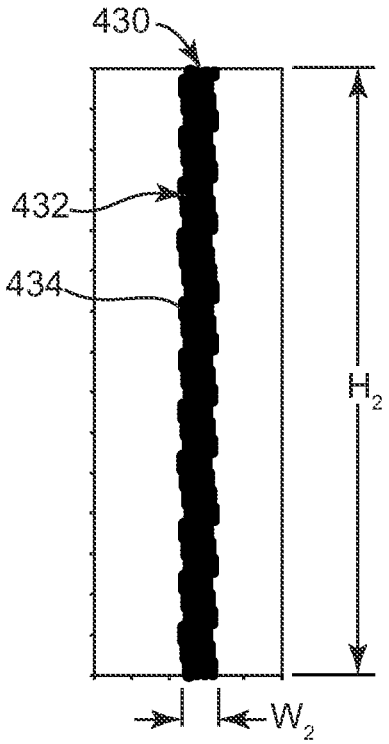
Fig. 9A
440
| OFFSET | | 0 | 0 | 0 |
|---|---|---|---|---|
| I | A | B | C | D |
| 1 | 10 | 10 | 10 | 10 |
| 2 | 6 | 6 | 6 | 6 |
| 3 | 2 | 2 | 2 | 2 |
| 4 | 11 | 11 | 11 | 11 |
| 5 | 7 | 7 | 7 | 7 |
| 6 | 3 | 3 | 3 | 3 |
| 7 | 12 | 12 | 12 | 12 |
| 8 | 8 | 8 | 8 | 8 |
| 9 | 4 | 4 | 4 | 4 |
| 10 | 13 | 13 | 13 | 13 |
| 11 | 9 | 9 | 9 | 9 |
| 12 | 5 | 5 | 5 | 5 |
| 13 | 1 | 1 | 1 | 1 |
Fig. 9B
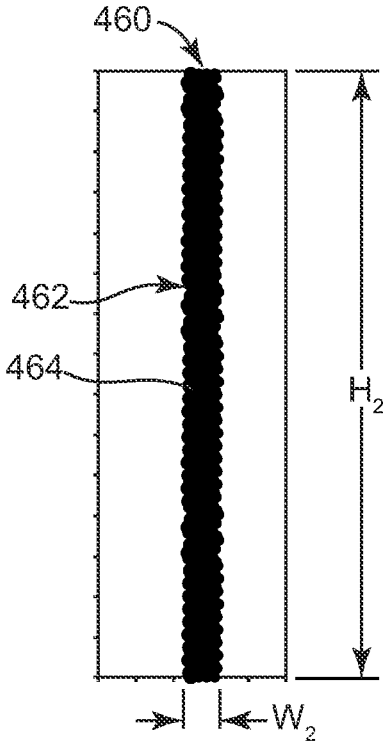
Fig. 10A
470
| OFFSET | | 1 | 4 | 5 |
|---|---|---|---|---|
| I | A | B | C | D |
| 1 | 10 | 6 | 7 | 3 |
| 2 | 6 | 2 | 3 | 12 |
| 3 | 2 | 11 | 12 | 8 |
| 4 | 11 | 7 | 8 | 4 |
| 5 | 7 | 3 | 4 | 13 |
| 6 | 3 | 12 | 13 | 9 |
| 7 | 12 | 8 | 9 | 5 |
| 8 | 8 | 4 | 5 | 1 |
| 9 | 4 | 13 | 1 | 10 |
| 10 | 13 | 9 | 10 | 6 |
| 11 | 9 | 5 | 6 | 2 |
| 12 | 5 | 1 | 2 | 11 |
| 13 | 1 | 10 | 11 | 7 |
Fig. 10B

ALTERING FIRING ORDER

BACKGROUND

An inkjet printing system may include a printhead, an ink supply which supplies liquid ink to the printhead, and an electronic controller which controls the printhead. The printhead ejects ink drops through a plurality of orifices or nozzles and toward a print media, such as a sheet of paper, to cause printing onto the print media. Drop placement errors can cause difficulty in achieving desired levels of print quality.

BRIEF DESCRIPTION OF THE DRAWINGS

FIG. 7A is a representation of a black text element printed via a printhead including non-staggered nozzles, according to one embodiment of the present disclosure.

FIG. 7B is a chart illustrating a firing order program for the respective columns of nozzles of the printhead used to print the black text element illustrated in FIG. 7A, according to one embodiment of the present disclosure.

FIG. 8A is a representation of a black text element printed via a printhead including non-staggered nozzles and an offset, non-sequential firing order program, according to one embodiment of the present disclosure.

FIG. 8B is a chart illustrating the offset, non-sequential firing order program for the respective columns of nozzles of the printhead used to print the black text element illustrated in FIG. 8A, according to one embodiment of the present disclosure.

FIG. 9A is a representation of a black text element printed via a printhead including non-staggered nozzles, according to one embodiment of the present disclosure.

FIG. 9B is a chart illustrating a firing order program for the respective columns of nozzles of the printhead used to print the black text element illustrated in FIG. 7A, according to one embodiment of the present disclosure.

FIG. 10A is a representation of a black text element printed via the same printhead of FIG. 9A except printed by employing an offset, non-sequential firing order program, according to one embodiment of the present disclosure.

FIG. 10B is a chart illustrating the offset, non-sequential firing order program for the respective columns of nozzles of the printhead used to print the black text element illustrated in FIG. 10A, according to one embodiment of the present disclosure.

DETAILED DESCRIPTION

Figure 1:
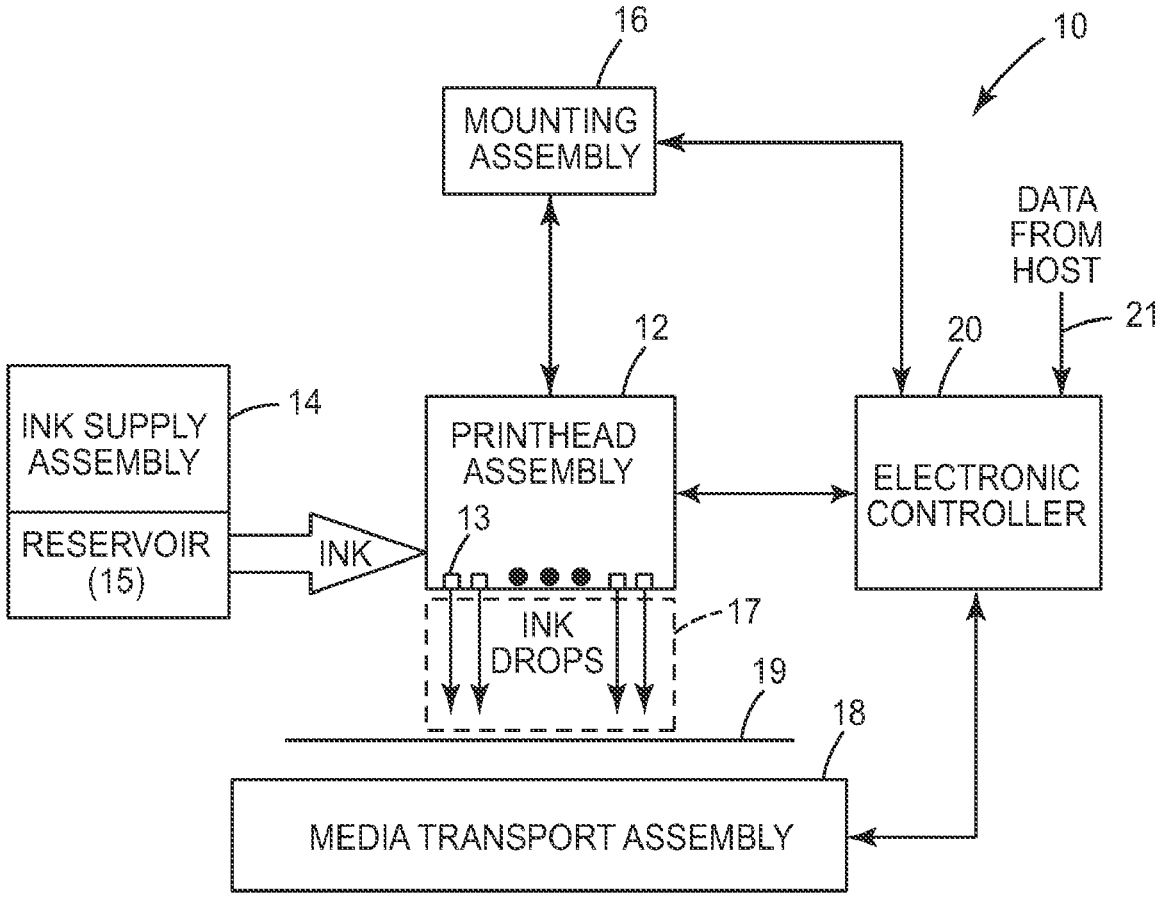
FIG. 1 is a block diagram illustrating an inkjet printing system, according one embodiment of the present disclosure.

In the following detailed description, reference is made to the accompanying drawings which form a part hereof, and in which is shown by way of illustration specific embodiments in which the subject matter of the present disclosure may be practiced. In this regard, directional terminology, such as "top," "bottom," "front," "back," "leading," "trailing," etc., is used with reference to the orientation of the Figure(s) being described. Because components of embodiments of the present disclosure can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

Embodiments of the present disclosure are directed to a printhead and a method of printing to produce printable elements with smooth vertical edges. In one aspect, the printable elements comprise non-image elements such as text (e.g., characters, numerals, symbols) or graphics that are printed at a low resolution. In one embodiment, the printable elements are printed at a resolution, such as 600 dpi or 1200 dpi, which is substantially less than a high resolution, such as 2400 dpi, used for printing images such as photographs. In another embodiment, the printable elements are printed entirely in black or substantially in black. In one embodiment, the printable non-image elements are printed in black text or black graphics without other colors.

In one embodiment, this method produces sharper and crisper vertical edges that are desirable for non-image elements, such as black text, whereas image printing does not depend as much on the quality of the vertical edges to produce the overall quality of for the output.

In one embodiment, a printhead includes at least two adjacent columns of nozzles arranged in a non-staggered pattern. In other words, the nozzles are not staggered relative to each other along a horizontal orientation (i.e. along the scan axis direction). The printhead is configured, via a controller, to employ a non-sequential and non-simultaneous firing order of the nozzles in which the firing order is altered to differ between the at least two adjacent columns of nozzles. In one aspect, the firing order is altered via a physical offset (along a vertical orientation) between the at least two adjacent columns of nozzles. In another aspect, the firing order is altered via maintaining the same firing order for each respective column of nozzles but causing a different nozzle of each respective column of nozzles to initiate or start the sequence of firing the nozzles. In other words, while having the same firing order, each respective column has a different starting nozzle, thereby resulting in an offset between the respective starting nozzles. In another aspect, the firing order is altered via using a different firing order for each column of nozzles.

In one aspect, dot placement errors are associated with the non-sequential, non-simultaneous firing order of the adjacent columns of non-staggered nozzles and the alteration of the firing order of the respective adjacent columns of nozzles is used to hide these dot placement errors. In particular, the altered firing order among adjacent columns of nozzles causes an intermingling or blending of maximum dot placement errors with minimum dot placement errors to introduce a high spatial frequency noise into the otherwise rough pattern of the vertical edge of the printable element. This high spatial frequency noise produced by the altered firing orders effectively obscures the roughness pattern or jaggedness of the vertical edge that would otherwise be produced by the same firing order if used in a non-staggered nozzle arrangement of the printhead.

In one aspect, this arrangement increases or maximizes the relative dot placement errors of adjacent nozzles so as to minimize lower spatial frequency noise in the pattern of the vertical edge of the printable element.

In one embodiment, a method of printing comprises determining a roughness pattern of a vertical edge of a printable element produced by a non-sequential, non-simultaneous firing order for a set of columns of nozzles. In order to decrease the roughness pattern of the vertical edge of the printable element, an alteration in the firing order offset is applied, via a controller of a printhead or a physical printhead layout. In this manner, each column of nozzles uses a different vertical location to initiate a cycle of firing.

Embodiments of the present disclosure enable the elimination of a staggered nozzle pattern, which reduces difficulties associated with multiple shelf lengths for staggered nozzles, such as a limitation on printhead speed corresponding to the fluidic variations among varied shelf lengths and the longest shelf length. Moreover, conventional staggered nozzle designs are more expensive and time consuming to produce because of the extra structural complexity to provide fluidic routing for the staggered nozzle arrangement. In addition, staggered nozzle designs are typically associated with a shorter resistor life for the printhead.

In contrast, by enabling the elimination of stagger among the nozzles, embodiments of the present disclosure achieve printheads having faster firing frequencies, longer resistor life, and a simplified fluidic design permitting a quicker path to market.

However, in another embodiment, embodiments of the present disclosure are applied to a printhead already having a staggered pattern of nozzles to achieve a more desirable a roughness pattern of a vertical edge of a printable element that appears when the stagger does not match the print mode. In one non-limiting example, the printhead has a stagger of 1200 dpi and is used in a print mode of 600 dpi, thereby producing some level of vertical edge roughness. By altering the firing order as described above, edge roughness associated with the printhead (and the mismatch between the print mode dpi and stagger dpi) is smoothed via redistributing the maximum dot placement errors among the minimum dot placement errors.

These embodiments, and additional embodiments, are described in association with FIGS. 1-11.

FIG. 1 illustrates an inkjet printing system 10, according to one embodiment of the present disclosure. Inkjet printing system 10 constitutes one embodiment of a fluid ejection system which includes a fluid ejection assembly, such as an inkjet printhead assembly 12, and a fluid supply assembly, such as an ink supply assembly 14. In the illustrated embodiment, inkjet printing system 10 also includes a mounting assembly 16, a media transport assembly 18, and an electronic controller 20. Inkjet printhead assembly 12, as one embodiment of a fluid ejection assembly, is formed according to an embodiment of the present disclosure, and includes one or more printheads or fluid ejection devices which eject drops of ink or fluid through a plurality of orifices or nozzles 13. In one embodiment, the drops are directed toward a medium, such as print medium 19, so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes, in one embodiment, characters, symbols, and/or other graphics or images to be printed upon print medium 19 as inkjet printhead assembly 12 and print medium 19 are moved relative to each other.

Ink supply assembly 14, as one embodiment of a fluid supply assembly, supplies ink to printhead assembly 12 and includes a reservoir 15 for storing ink. As such, in one embodiment, ink flows from reservoir 15 to inkjet printhead assembly 12. In this embodiment, ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, a portion of the ink supplied to printhead assembly 12 (which may be less than all the ink supplied) is consumed during printing. As such, a portion of the ink not consumed during printing is returned to ink supply assembly 14.

In one embodiment, inkjet printhead assembly 12 and ink supply assembly 14 are housed together in an inkjet or fluidjet cartridge or pen. In another embodiment, ink supply assembly 14 is separate from inkjet printhead assembly 12 and supplies ink to inkjet printhead assembly 12 through an interface connection, such as a supply tube (not shown). In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge and/or a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
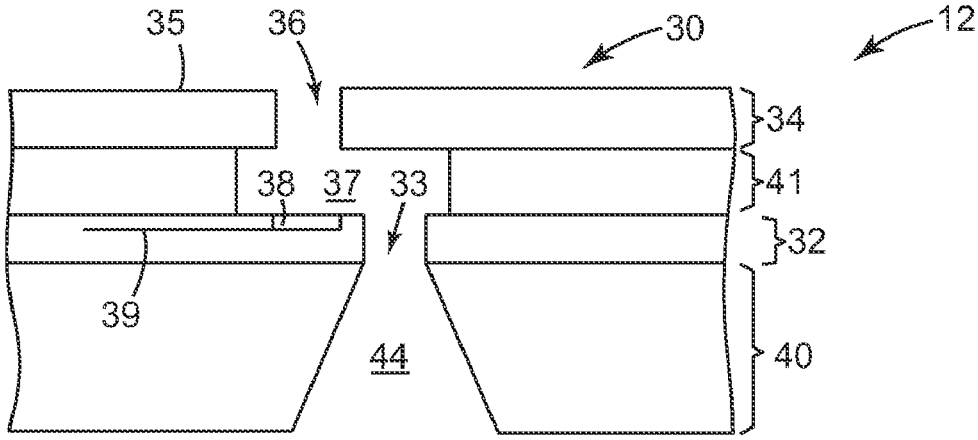
FIG. 2 is a schematic cross-sectional view illustrating a portion of a fluid ejection device, according to one embodiment of the present disclosure.

FIG. 2 illustrates one embodiment of a portion of inkjet printhead assembly 12. Inkjet printhead assembly 12, as one embodiment of a fluid ejection assembly, includes an array of drop ejecting elements 30. Drop ejecting elements 30 are formed on a substrate 40 which has a fluid (or ink) feed slot 44 formed therein. As such, fluid feed slot 44 provides a supply of fluid (or ink) to drop ejecting elements 30.

In one embodiment, each drop ejecting element 30 includes a thin-film structure 32, an orifice layer 34, and a firing resistor 38. Thin-film structure 32 has a fluid (or ink) feed channel 33 formed therein which communicates with fluid feed slot 44 of substrate 40. Orifice layer 34 has a front face 35 and a nozzle opening 36 formed in front face 35. Orifice layer 34 also has a nozzle chamber 37 formed therein which communicates with nozzle opening 36 and fluid feed channel 33 of thin-film structure 32. Firing resistor 38 is positioned within nozzle chamber 37 and includes leads 39 which electrically couple firing resistor 38 to a drive signal and ground.

In one embodiment, during operation, fluid flows from fluid feed slot 44 to nozzle chamber 37 via fluid feed channel 33. Nozzle opening 36 is operatively associated with firing resistor 38 such that droplets of fluid are ejected from nozzle chamber 37 through nozzle opening 36 (e.g., normal to the plane of firing resistor 38) and toward a medium upon energization of firing resistor 38.

Later embodiments of the present disclosure are not strictly limited to the structure illustrated in FIG. 2, which is provided as just one example of the structure of printhead assembly 12. Other fluid ejection structures of a printhead assembly are known to those skilled in the art, and which also are usable with embodiments of the present disclosure described herein.

Example embodiments of inkjet printhead assembly 12 include a thermal printhead, a piezoelectric printhead, a flex-tensional printhead, or any other type of fluid ejection device known in the art. In one embodiment, inkjet printhead assembly 12 is a fully integrated thermal inkjet printhead. As such, substrate 40 is formed, for example, of silicon, glass, or a stable polymer, and thin-film structure 32 is formed by one or more passivation or insulation layers of silicon dioxide, silicon carbide, silicon nitride, tantalum, poly-silicon glass, or other suitable material. Thin-film structure 32 also includes a conductive layer which defines firing resistor 38 and leads 39. The conductive layer is formed, for example, by aluminum, gold, tantalum, tantalum-aluminum, or other metal or metal alloy.

Figure 3:
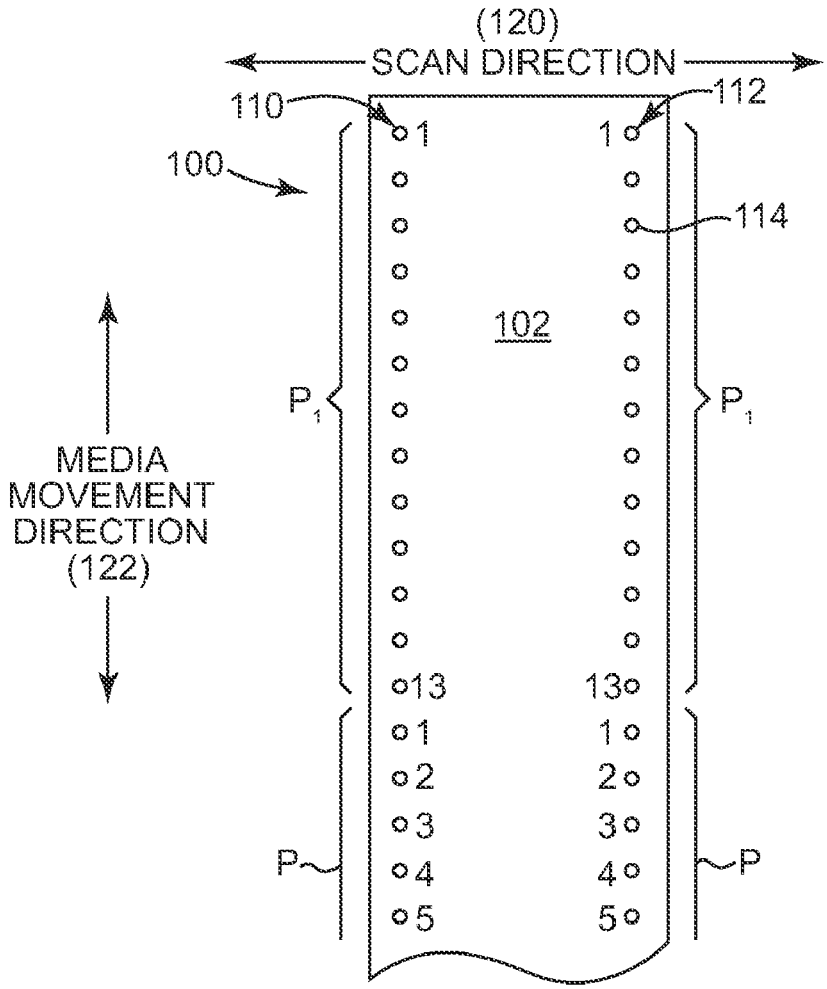
FIG. 3 is a partial plan view of a nozzle plate of a printhead, according to one embodiment of the present disclosure.

FIG. 3 is a top plan view of a portion of a printhead assembly 100, according to one embodiment of the present disclosure, representing a layout of two columns of nozzles. The arrangement of columns 110, 112 illustrated in FIG. 3 is merely illustrative of a whole range of possible arrangements of columns, primitives, and nozzles to which embodiments of the present disclosure can be applied.

As illustrated in FIG. 3, printhead assembly 100 comprises a nozzle plate 102 including two columns 110, 112 of nozzles 114. The nozzles 114 of each respective column 110, 112 are grouped together in primitives (as represented by P1, P2, etc.). In this non-limiting example, there are thirteen nozzles 114 for each primitive. In one aspect, the respective columns 110, 112 are laterally spaced apart from each other with the nozzles 114 within each column 110, 112 arranged in a non-staggered pattern. In another aspect, the respective columns 110, 112 of nozzles 114 are each arranged generally perpendicular to a scan direction 120 and generally parallel to a media movement direction 122.

Figure 4:
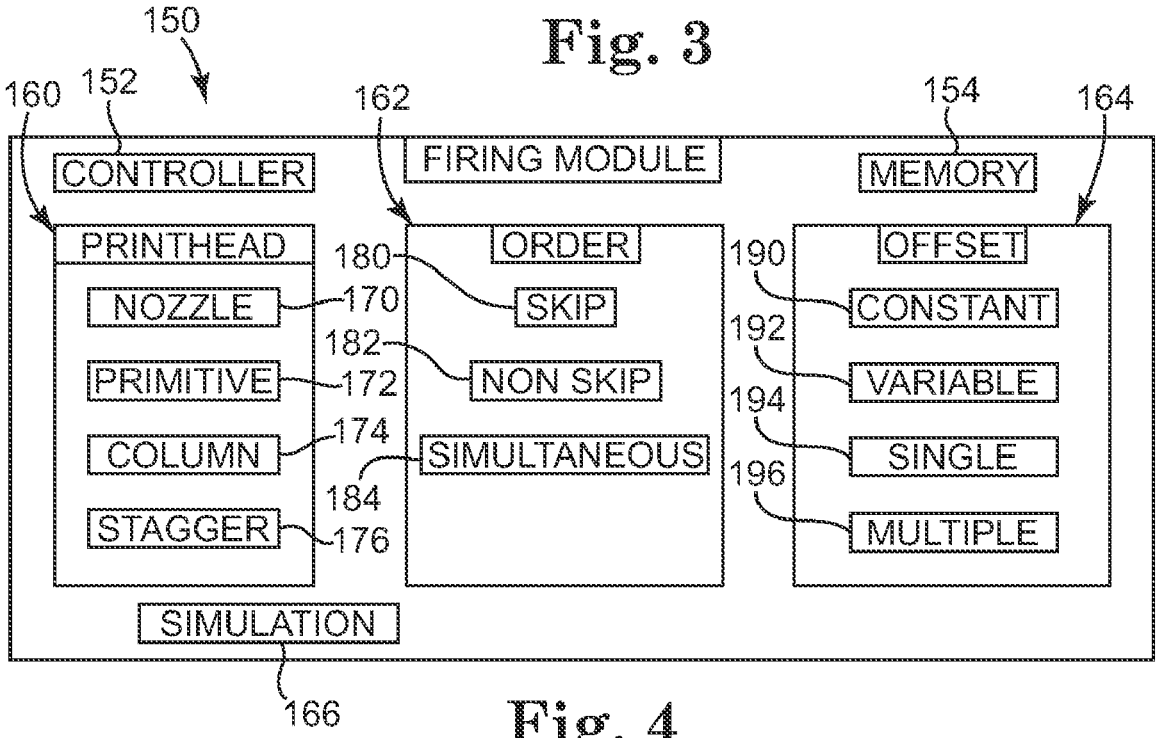
FIG. 4 is a block diagram of a firing module for a printhead, according to one embodiment of the present disclosure.

FIG. 4 is a block diagram of a firing module 150, according to one embodiment of the present disclosure. As illustrated in FIG. 4, firing module 150 comprises controller 152, memory 154, printhead module 160, order module 162, offset module 164, and simulation module 166. In one embodiment, firing module 150 enables control the firing of nozzles of a printhead assembly, such as the printhead assembly 100 illustrated in FIG. 3 or other printhead assemblies. Firing module 150 controls the initiation, timing, and/or cessation of firing the nozzles, as well as a firing order of the nozzles.

In one aspect, controller 152 is configured to operate firing module 150. In one embodiment, controller 152 comprises controller 20 as previously described in association with FIG. 1. In one aspect, memory 154 is configured to store firing module 150 for operation and communication with controller 152. In one embodiment, memory 154 is formed as part of controller 152.

Printhead module 160 stores, or receives input of, the hardware parameters of a printhead assembly for which the firing order will be set. In one embodiment, printhead module 160 comprises nozzle parameter 170, primitive parameter 172, column parameter 174, and stagger parameter 176. Column parameter 174 identifies the number of columns of nozzles for the printhead assembly while primitive parameter 172 identifies the number of primitives for each respective column. Nozzle parameter 170 identifies the total number of nozzles for each respective column as well as the number of nozzles per primitive. In one aspect, stagger parameter 176 identifies the amount of stagger. For example, in one embodiment, where some stagger is present in the printhead, an alteration of the firing order will still achieve a more desirable edge roughness. In one example, in a printhead using a print mode is 600 dpi, and having a nozzle stagger of 1200 dpi, an altered firing order achieves a more desirable edge roughness. In this aspect, the altered firing order is achieved via using different starting nozzles of the same firing order of the adjacent columns of nozzles or by using different firing orders for each respective adjacent column of nozzles.

Order module 162 enables control over the order of firing nozzles of a printhead. In one embodiment, order module 162 comprises skip parameter 180, non-skip parameter 182, and simultaneous parameter 184. Skip parameter 180 sets the firing order to have a uniform skip sequence (e.g., skip 2, skip 3, etc.) in which the nozzles are fired in a rotation that skips one or more nozzles (at a time) in the rotation between firing. Non-skip parameter 182 sets the firing order to have a non-skip sequence. Simultaneous parameter 182 sets the firing order of nozzles to either cause simultaneous firing or non-simultaneous firing of nozzles. In another aspect, order module 162 applies skip parameter 180 to set a non-traditional firing order that is non-sequential but follows a non-uniform skip pattern.

Offset module 164 enables control over which nozzle within a firing order is the nozzle initiates the firing sequence. In one embodiment, offset module 164 comprises constant parameter 190, variable parameter 192, single parameter 194, and multiple parameter 196. Constant parameter 190 enables control over whether the offset is constant among the firing order of multiple columns while variable parameter 192 enables control to set a variable amount of offset among a plurality of columns (e.g., 3, 4, etc.). In another aspect, single parameter 194 enables applying an offset to one adjacent column while multiple parameter 196 enables control to apply an offset to several columns of nozzles. In one aspect, the offset applied via the multiple parameter 196 is constant among the multiple columns while in another aspect, the offset applied via the multiple parameter 196 is different (i.e., variable) among the multiple columns.

In one embodiment, firing module 150 comprises a simulation module 166 that enables a simulation of printing a black text element via settings of the various parameters of the printhead module 160, order module 162, and offset module 164 of firing module 150. The simulation module 166 is viewable on a display associated with a computer in communication with the firing module 150 via controller 152 of a printhead assembly of a printer.

FIGS. 5A-10B illustrate various representations of a black text element, which includes characters, symbols, numerals, and other elements printed at a low resolution such as 600 dpi or 1200 dpi that is substantially less than a high resolution of 2400 dpi. In one aspect, it is understood that higher resolution images (such as photos) will not have significant edge roughness defects because they are printed primarily in color and because these roughness defects are not readily visible at those resolutions.

In another embodiment, while FIGS. 5A-10B illustrate and refer to a black text element, embodiments of the present disclosure are not limited to black printable elements but extend to printable elements including color that are printed at a low resolution (600 dpi or 1200 dpi). Accordingly, it is understood that the features and attributes of the embodiments (described in association with FIGS. 5A-10B) referring to black text elements, also apply to non-black or partially black elements printable at low resolutions, such as 600 dpi or 1200 dpi.

Figure 5A:
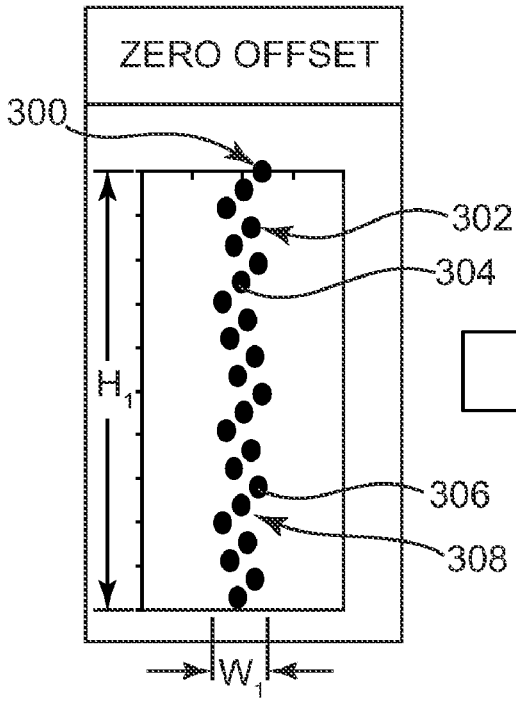
FIG. 5A is a representation of a black text element printed via a printhead including non-staggered nozzles, according to one embodiment of the present disclosure.

Embodiments of the present disclosure hide vertical edge roughness in printable elements by first establishing a degree and type of edge roughness associated with a particular printhead and a firing order of its nozzles. Accordingly, FIG. 5A is a top plan view that illustrates an enlarged representation of a dot pattern that forms black text element 300, including a vertical edge 302, as printed via a printhead, according to one embodiment of the present disclosure. In one aspect, the black text element 300 illustrated in FIG. 5A is printed via a printhead with non-sequential and non-simultaneous firing order with the nozzles of respective columns arranged in a non-staggered pattern. In one aspect, the firing order of the adjacent columns of nozzles of the printhead is symmetrical.

As illustrated in FIG. 5A, the vertical edge 302 of black text element 300 comprises a pattern having a generally zigzag shape 304. In one aspect, with this generally zigzag shape, a width (W1) of vertical edge 302 of black text element 300 varies considerably along a height (H1) of the black text element 300. The generally zigzag shape 304 repeats in correspondence with the repeating cycle of the firing order rotation of the nozzles, thereby causing a generally rough pattern or jagged pattern in vertical edge 302 including a repeating series of peaks 306 and recesses 308 in the generally zigzag shape 304. By actual printing black text with this vertical edge pattern or by simulating it, one can identify the type of roughness (of vertical edge 302 of black text element 300) associated with a pattern of non-staggered nozzles and its particular firing order.

Figure 5B:
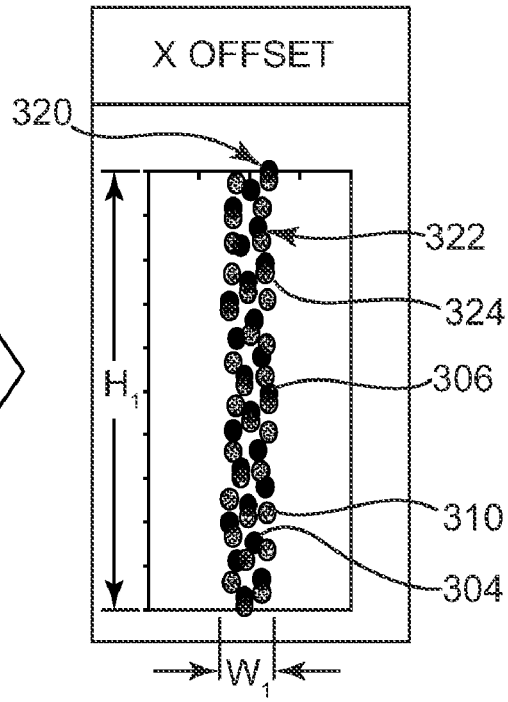
FIG. 5B is a representation of a black text element printed via a printhead including non-staggered nozzles and an offset, non-sequential firing order program, according to one embodiment of the present disclosure.

FIG. 5B is a top plan view that illustrates an enlarged representation of a dot pattern forming a black text element 320, including a vertical edge 322, printed via a printhead and a firing order, according to one embodiment of the present disclosure. The black text element illustrated in FIG. 5B is printed via a printhead with a non-sequential and non-simultaneous firing order with the nozzles of respective columns arranged in a non-staggered pattern. However, in this embodiment, using the roughness pattern observed from FIG. 5A, the starting nozzles of the firing order of respective adjacent columns of nozzles are offset from each other. Accordingly, while each column has the same non-sequential, non-simultaneous firing order, this offset arrangement causes each column to be fired beginning with a different nozzle in the rotation of the firing order.

By creating this offset, a high spatial frequency noise is introduced into the pattern 324 of the vertical edge 322 of black text element 320, as illustrated in FIG. 5B, to effectively hide the jaggedness or roughness of the vertical edge 302 of black text element 300 (illustrated in FIG. 5A) that was present before introduction of the offset. In one aspect, the offset (between the starting nozzles of adjacent columns) is selected to intermingle or blend maximum dot placement errors among minimum dot placement errors. As illustrated in FIG. 5B, dot 310 corresponds to one maximum dot placement error that is repositioned within or adjacent one of the recesses of the zig-zag shape 304 (present in the pattern shown in FIG. 5A) that correspond to a minimum dot placement error. Accordingly, with this arrangement, the printable element 320 printed via the offset (between the starting nozzles of the firing order of adjacent columns of nozzles) when viewed from a normal reading distance will appear as having a generally smooth vertical edge 322. In one aspect, the details of this high spatial frequency noise appear on scale that is not detectable by the human eye so that the reader is aware that the black text has a more uniform vertical edge without substantially perceiving the details of the high spatial frequency noise.

Figure 6A:
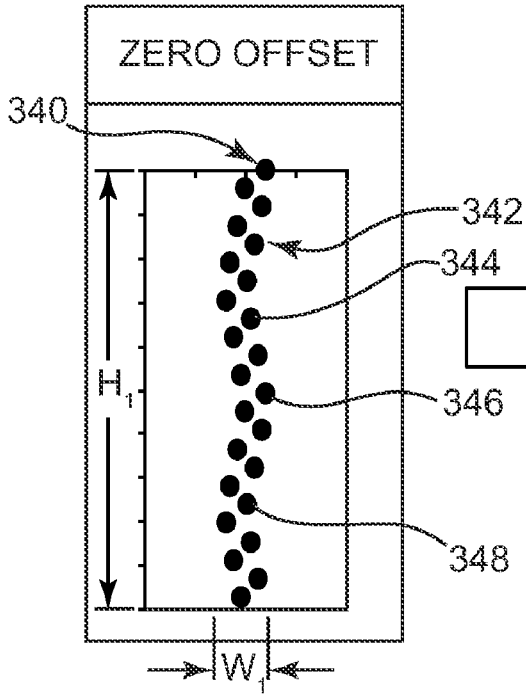
FIG. 6A is a representation of a black text element printed via a printhead including non-staggered nozzles, according to one embodiment of the present disclosure.

Embodiments of the present disclosure hide vertical edge roughness in printable elements by first establishing a degree and type of edge roughness associated with a particular printhead and with a firing order of its non-staggered nozzles. Accordingly, FIG. 6A is a top plan view that illustrates an enlarged representation of a dot pattern forming printed black text element 340, including a vertical edge 342, printed via a printhead, according to one embodiment of the present disclosure. In one aspect, the black text element 340 illustrated in FIG. 6A is printed via a printhead with non-sequential and non-simultaneous firing order with the nozzles of respective columns arranged in a non-staggered pattern. In another aspect, the firing order of the adjacent columns of nozzles of the printhead is symmetrical.

As illustrated in FIG. 6A, the vertical edge 342 of black text element 340 comprises a pattern having a generally sine wave shape 344. In one aspect, with this generally sine wave shape, a width (W1) of vertical edge 342 of black text element 340 varies considerably along a height (H1) of the black text element 340. The generally sine wave shape 344 repeats in correspondence with the repeating cycle of the firing order rotation of the nozzles, thereby causing a generally rough pattern in vertical edge 342 including repeating peaks 346 and valleys 348 in the generally sine wave shape 344. By actual printing black text with this vertical edge pattern or by simulating it, one can identify the type of vertical edge roughness associated with a pattern of non-staggered nozzles and its particular firing order.

Figure 6B:
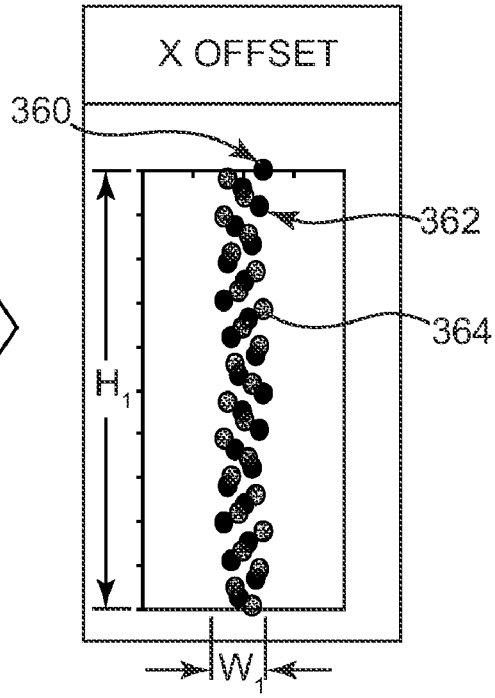
FIG. 6B is a representation of a black text element printed via a printhead including non-staggered nozzles and an offset, non-sequential firing order program, according to one embodiment of the present disclosure.

FIG. 6B is a top plan view that illustrates an enlarged representation of a dot pattern forming a black text element 360, including a vertical edge 362, printed via a printhead and a firing order, according to one embodiment of the present disclosure. The black text element illustrated in FIG. 6B is printed via a printhead with a non-sequential and non-simultaneous firing order with the nozzles of respective columns arranged in a non-staggered pattern. However, in this embodiment, using the roughness pattern observed in FIG. 6A, the starting nozzle of the firing order of respective adjacent columns of nozzles are offset from each other. Accordingly, while each column has the same non-sequential, non-simultaneous firing order, this offset arrangement causes each column to be fired beginning with a different nozzle in the rotation of the firing order.

By creating this offset, a high spatial frequency noise is introduced into the pattern 364 of the vertical edge 362 of black text element 360, as illustrated in FIG. 6B, to effectively hide the roughness (i.e., jaggedness) of the vertical edge 342 of black text element 300 (illustrated in FIG. 5A) that was present before introduction of the offset. In one aspect, the offset (between the starting nozzles of adjacent columns) is selected to intermingle or blend maximum dot placement errors among minimum dot placement errors. With this arrangement, a black text element printed via the offset (between the starting nozzles of the firing order of adjacent columns of nozzles) when viewed from a normal reading distance will appear as having a generally smooth vertical edge. In one aspect, the details of this high spatial frequency noise appear on scale that is at least not substantially detectable by the human eye so that the reader is aware that the black text has a more uniform vertical edge without substantially perceiving the details of the high spatial frequency noise.

Embodiments of the present disclosure hide vertical edge roughness in printable elements by first establishing a degree and type of edge roughness associated with a particular printhead and with a firing order of its non-staggered nozzles. Accordingly, FIG. 7A is a top plan view that illustrates an enlarged representation of a simulated printed black text element 380, including a vertical edge 382, printed via a printhead, according to one embodiment of the present disclosure. In one aspect, the black text element 380 illustrated in FIG. 7A is printed via a printhead with a non-sequential and non-simultaneous firing order with the nozzles of respective columns arranged in a non-staggered pattern. In this representation, black text element 380 includes a width (W2) on the order of 100 microns, while the portion of black text element 380 shown in FIG. 7A corresponds to a height about 3000 microns.

As illustrated in FIG. 7A, the vertical edge 382 of black text element 380 comprises a pattern having a generally zigzag shape 384 that repeats itself in correspondence with cycles of the firing order rotation.

In one aspect, the peaks 386 and valleys 388 cause relatively large deviations in the width of the black text element 380 (along the height of the black text element 380), thereby causing the visibly notable roughness in vertical edge 382. In one embodiment, each zigzag segment of black text element 380 has a height of about 100 microns. By actually printing black text with this vertical edge pattern or by simulating it (as illustrated in FIG. 7A), one can identify the type of vertical edge roughness associated with a pattern of non-staggered nozzles and its particular firing order.

FIG. 7B is a chart illustrating a firing order program 390 associated with the printhead that produces the black text element 380 illustrated in FIG. 7A, according to one embodiment of the present disclosure. Accordingly, in one aspect, the firing order program 390 and printhead employ a staggerless arrangement of nozzles. As illustrated in FIG. 7B, in each respective column of nozzles, there are thirteen nozzles per primitive. Column I represents the physical layout of nozzles on the printhead with columns A and B representing the order in which the nozzles are fired. The firing order for each respective column A, B is non-sequential rotation of nozzles 1, 5, 9, 13, 4, 8, 12, 3, 7, 11, 2, 6, 10. Because nozzle 1 is the starting nozzle in the firing rotation for each respective column, there is no offset in the firing order between the two columns. In one aspect, this firing order is referred to as a skip 3 sequence with an odd, even firing pattern (because multiple odd numbered nozzles are fired in series before firing multiple even numbered nozzles, and so on).

FIG. 8A is a top plan view that illustrates an enlarged representation of a simulated printed black text element 410, including a vertical edge 412, printed via a printhead, according to one embodiment of the present disclosure. In one aspect, the black text element 410 illustrated in FIG. 8A is printed via the same printhead as in FIGS. 7A-7B (with the nozzles of respective columns arranged in a non-staggered pattern) except with an offset between the starting nozzles of the firing orders of the respective columns A, B.

As illustrated in FIG. 8A, the vertical edge 412 of black text element 410 comprises a pattern having a shape 414 that repeats itself in correspondence with cycles of the firing order rotation. In one aspect, the shape 414 produces a vertical edge 412 having a mildly irregular knobs or bumps with a distance (e.g. height) between adjacent "knobs" being about 5-10 microns. This distance is substantially less than the distance (i.e., about 40 microns) between the adjacent zigzag segments of the black text element 380 in FIG. 7A that is not produced via an offset of starting nozzles. In another aspect, the actual shape of each knob or bump forming the vertical edge 414 may be a variety of suitable shapes. Rather, the generally smoother vertical edge as perceived by the reader is achieved because the irregularity occurs on a vertical scale (e.g., height) and a horizontal scale (e.g., width) that is substantially smaller than the jaggedness of the vertical edge 382 of black text element 380 and which is not observable during normal reading of the black text element 410. This effect is achieved via the offset which effectively adds a high spatial frequency noise pattern to the basic pattern of the vertical edge caused by the firing order.

Accordingly, by actually printing black text with this vertical edge pattern or by simulating it (as illustrated in FIG. 8A), one can identify the decrease in the roughness pattern of the vertical edge associated with a pattern of non-staggered nozzles and a particular offset firing order.

FIG. 8B is a chart illustrating a firing order program 420 associated with the printhead that produces the black text element 410 illustrated in FIG. 8A, according to one embodiment of the present disclosure. In one aspect, the firing order program 420 and printhead employ a staggerless arrangement of nozzles. However, in this embodiment as illustrated in firing order program 420 of FIG. 8B, there is an offset of four between the starting nozzles in the firing order for each respective column.

Accordingly, in this embodiment illustrated in FIG. 8B, while the firing order remains the same as in the firing order program 390 of FIG. 7B, the firing of column A is initiated with nozzle 1 and followed by nozzles 5, 9, 13, 4, 8, 12, 3, 7, 11, 2, 6, 10 while firing of column B is initiated with nozzle 4 and followed by nozzles 8, 12, 3, 7, 11, 2, 6, 10, 1, 5, 9, and 13. Because nozzle 1 is the starting nozzle in the firing rotation for column A and nozzle 4 is the starting nozzle for column B, there are four places of difference within the firing order rotation between the two columns. In other words, the respective columns have an offset of four between the starting nozzles of their otherwise identical firing orders.

This offset causes re-location of dot placement errors so that the former zigzag pattern 384 of vertical edge 382 of black text element 380 (associated with the firing order and staggerless arrangement of nozzles) becomes obscured by the introduction of high spatial frequency noise. While there does appear to be some irregularity along the vertical edge 382, when viewed at a normal scale, this vertical edge appears much smoother in comparison to the generally jagged vertical edge of the zigzag shape associated with the lack of a "starting nozzle" offset.

Embodiments of the present disclosure hide vertical edge roughness in printable elements by first establishing a degree and type of edge roughness associated with a particular printhead and with a firing order of its non-staggered nozzles. Accordingly, FIG. 9A is a top plan view that illustrates an enlarged representation of a simulated printed black text element 430, including a vertical edge 432, according to one embodiment of the present disclosure. In one aspect, the black text element 430 illustrated in FIG. 9A is printed via a printhead with a non-sequential and non-simultaneous firing order with the nozzles of respective columns arranged in a non-staggered pattern. In this representation, black text element 430 includes a width (W2) on the order of 100 microns, while the segment of black text element 430 shown in FIG. 9A corresponds to a height about 3000 microns.

As illustrated in FIG. 9A, the vertical edge 432 of black text element 430 comprises a pattern having a generally zigzag shape 434 that repeats itself in correspondence with cycles of the firing order rotation. In one embodiment, each zigzag segment has a height on the order of about 40 microns. By actually printing black text with this vertical edge pattern or by simulating it as illustrated in FIG. 9A, one can identify this type of vertical edge roughness associated with an arrangement of non-staggered nozzles and its particular firing order.

FIG. 9B is a chart illustrating a firing order program 440 associated with the printhead that produces the black text element 430 illustrated in FIG. 9A. In one aspect, the firing order program and printhead employ a staggerless arrangement of nozzles. As illustrated in FIG. 9B, in each respective column of nozzles, there are thirteen nozzles per primitive. Column I represents the physical layout of nozzles on the printhead with columns A, B, C, and D representing the order in which the nozzles are fired. The firing order for each respective column A, B, C, and D is non-sequential rotation of nozzles 10, 6, 2, 11, 7, 3, 12, 8, 4, 13, 9, 5, and 1. Because nozzle 10 is the starting nozzle in the firing rotation for each respective column, there is no offset in the firing order between the four columns.

FIG. 10A is a top plan view that illustrates an enlarged representation of a simulated printed black text element 460 including a vertical edge 462, according to one embodiment of the present disclosure. In one aspect, the black text element 460 illustrated in FIG. 10A is printed via the same printhead as in FIGS. 9A-9B (with the nozzles of respective columns arranged in a non-staggered pattern) except with an offset between the starting nozzle of the firing orders of the respective columns A, B, C, and D.

As illustrated in FIG. 10A, the vertical edge 462 of black text element 460 comprises a pattern having a shape 464 that repeats itself in correspondence with cycles of the firing order rotation. In one aspect, the distance (e.g. height) between adjacent "knobs" is about 5-10 microns. By actually printing black text with this vertical edge pattern or by simulating it as illustrated in FIG. 10A, one smoothes the vertical edge roughness that would otherwise be produced by the firing order program 440 (FIG. 9B) and the arrangement of non-staggered nozzles.

FIG. 10B is a chart illustrating a firing order program 470 associated with the printhead that produces the black text element 460 illustrated in FIG. 10A, according to one embodiment of the present disclosure. In one aspect, the firing order program and printhead employ a staggerless arrangement of nozzles. In one aspect, the printhead and the firing order are substantially the same the firing orders of the respective columns as provided in firing order program of FIG. 9B. However, in the firing order program of FIG. 10B, there is a variable offset (i.e., non-uniform offset) between the starting nozzles for the firing order of each respective column. In particular, column A begins firing with starting nozzle 10, followed by nozzles 6, 2, 11, 7, 3, 12, 8, 4, 13, 9, 5, and 1. However, column B begins firing with starting nozzle 6, followed by nozzles 2, 11, 7, 3, 12, 8, 4, 13, 9, 5, 1, and 10. Accordingly, the offset between columns A and B corresponds to one difference between the place of the starting nozzles of columns A and B. Column C begins firing with starting nozzle 7, followed by nozzles 3, 12, 8, 4, 13, 9, 5, 1, 10, 6, 2, and 11 while Column D begins firing with starting nozzle 3, followed by nozzles 12, 8, 4, 13, 9, 5, 1, 10, 6, 2, and 11. There is an offset of one between the starting nozzles of columns C and D while there is an offset of three between the starting nozzle (6) of the firing rotation of column B and the starting nozzle (7) of the firing rotation of column C.

Accordingly, in one aspect, the offset between the starting nozzles of the respective columns is referred to as being variable or non-uniform because different numerical offsets are applied between the four columns. However, once the variable offset among columns is applied, the offset does not change. In other words, the offset does not drift or change over time. Hence, the offset between columns A and B remains one, the offset between columns B and C remains three, and the offset between columns C and D remains one.

This offset causes re-location of dot placement errors so that the former zigzag pattern (associated with the firing order and staggerless arrangement of nozzles) becomes obscured by the introduction of high spatial frequency noise. While there does appear to be some irregularity along the vertical edge 462, when viewed at a normal scale, this vertical edge appears much smoother in comparison to the generally jagged vertical edge of the zigzag shape associated with the lack of a "starting nozzle" offset.

In one aspect, the variable offset is controlled via the variable parameter 192 of firing module 150 of FIG. 4.

Figure 11:
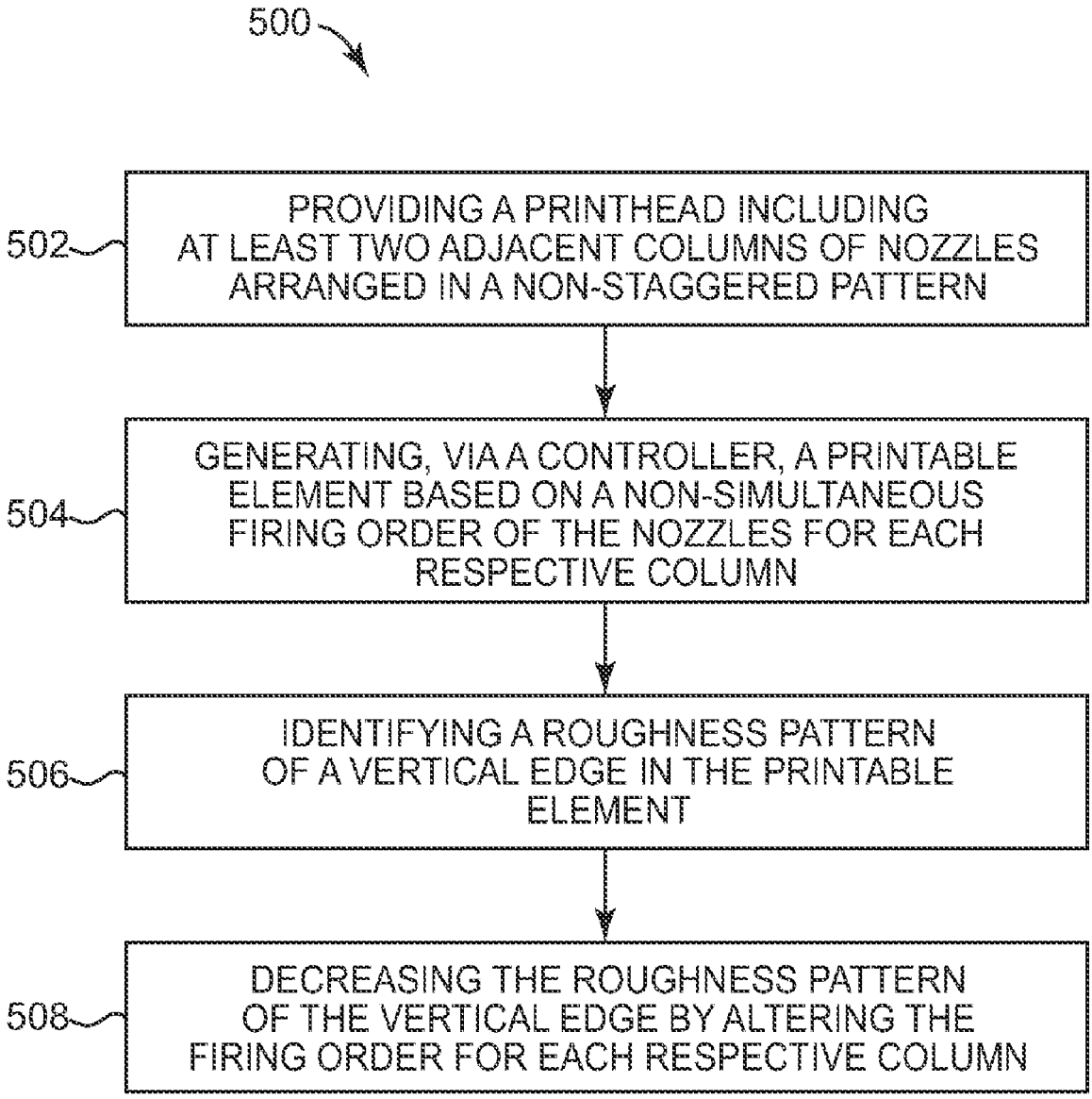
FIG. 11 is a flow diagram of a method of printing black text via a staggerless nozzle pattern, according to one embodiment of the present disclosure.

FIG. 11 is a flow diagram illustrating a method 500 of printing, according to one embodiment of the present disclosure. In one embodiment, method 500 is performed via the various embodiments previously described and illustrated in association with FIGS. 1-10 and those described later in association with FIGS. 12A-12B. In another embodiment, method 500 is performed using other types of printhead assemblies and firing orders.

As illustrated in FIG. 11, at 502 the method 500 comprises providing a printhead including at least two adjacent columns of nozzles arranged in a non-staggered pattern. At 504, a printable element is generated, via a controller, based on a non-simultaneous, non-sequential firing order of the nozzles for each respective column. At 506, the method 500 includes identifying a roughness pattern of a vertical edge of the printable element. At 508, a numerical offset of the starting nozzle of the firing order of the respective adjacent columns is used to decrease the roughness pattern of the vertical edge of the printable element.

In one non-limiting aspect, the roughness pattern of the vertical edge of the printable element comprises a jagged shape, such as a saw tooth or zigzag shape that forms sharp peaks and valleys. In another non-limiting aspect, the roughness pattern of the vertical edge of the black text element comprises a sine wave shape includes curves forming round peaks and valleys. Of course, in order to apply method 500, the roughness pattern of a vertical edge of a black text line may or may not correspond to a formally recognized geometric shape. Rather, any pattern of a vertical edge of a black text line that produces visibly recognizable poor vertical edges is a candidate for applying an offset between the starting nozzles of the firing order of adjacent columns of nozzles.

Figure 12A:
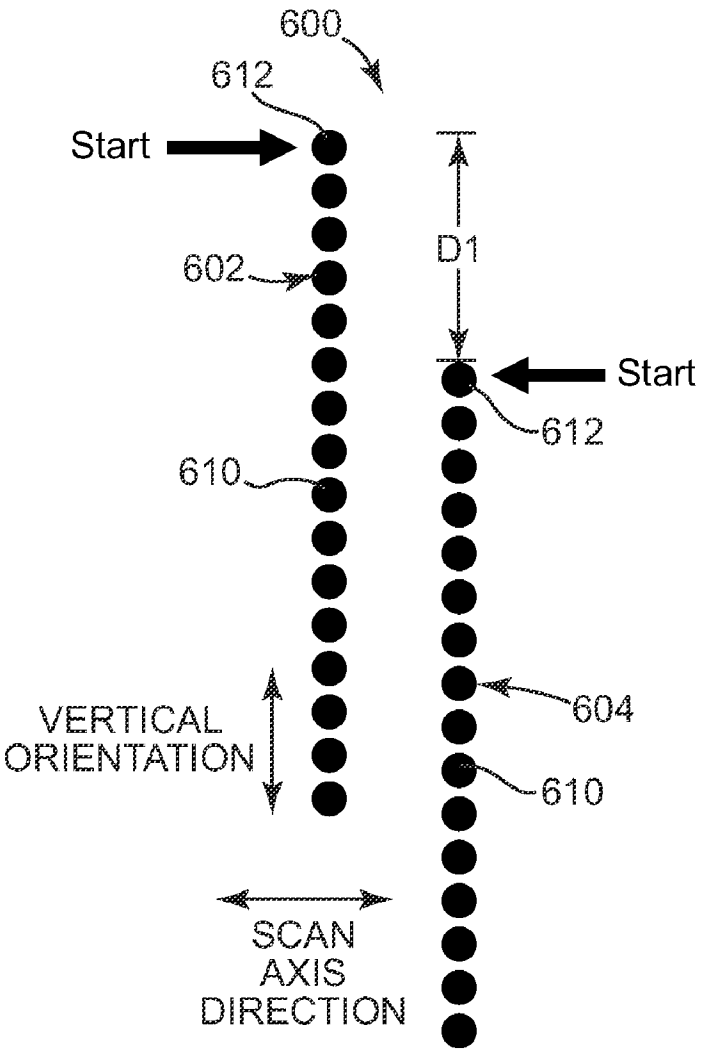
FIG. 12A is a top plan view illustrating a printhead layout of nozzles, according to one embodiment of the present disclosure.

While the embodiments illustrated in FIGS. 5A-11 are described with respect to using an offset of starting nozzles among adjacent columns of nozzles, it is understood that the other embodiments of altering a firing order (or introducing alternative offsets) can be used to produce the generally smoother vertical edge of a printable element 320. Accordingly, in another embodiment of the present disclosure, as illustrated in FIG. 12, a generally smoother vertical edge of a printable element (e.g., vertical edge 322 of printable element 320) is produced via forming the printhead with a nozzle layout in which one column of nozzles is vertically offset (i.e., generally perpendicular to the scan axis direction) from an adjacent column of nozzles. FIG. 12A illustrates a printhead layout 600 including at least two adjacent columns 602, 604 of nozzles 610 arranged generally parallel to each other in a side-by-side relationship. Column 604 is vertically offset from column 602 by a distance (D1) corresponding to a difference of one or more nozzle positions between a top nozzle 612 in the respective columns 602, 604 of nozzles. Each column 602, 604 of nozzles has the same non-sequential, non-simultaneous firing order. The same nozzle position is used to start a cycle of firing. In other words, the same starting nozzle is used for both columns 602, 604 of nozzles. Accordingly, the physical vertical offset causes a redistribution of maximum dot placement errors among minimum dot placement errors, thereby hiding vertical edge roughness in a printable element.

Figure 12B:
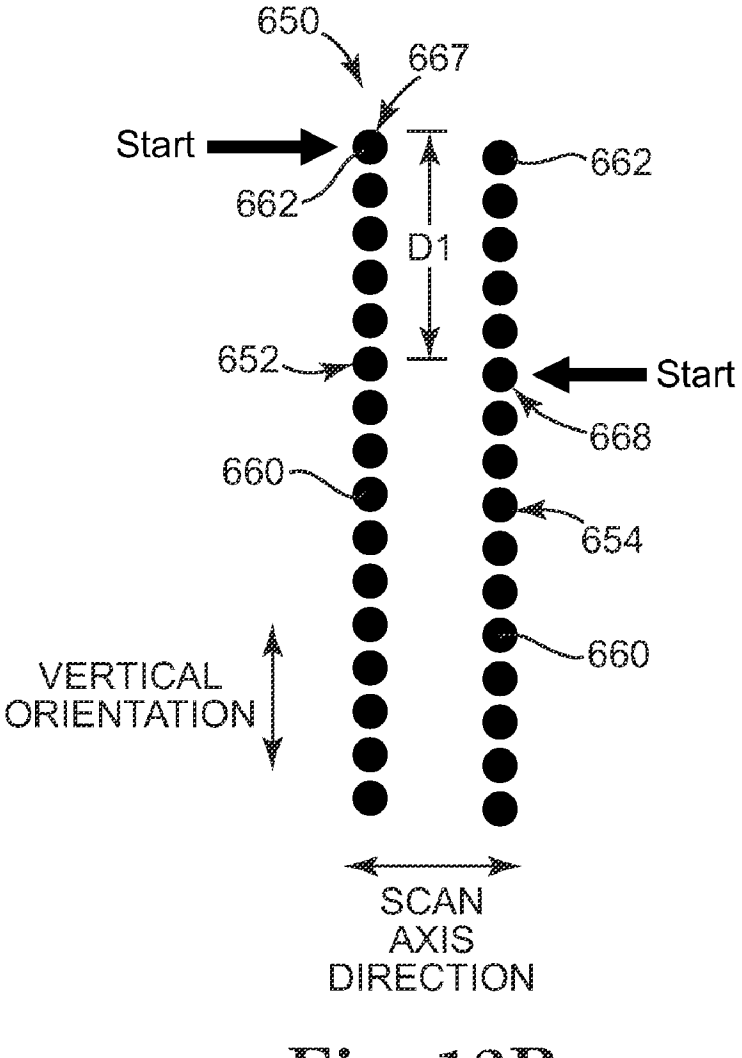
FIG. 12B is a top plan view illustrating a printhead layout of nozzles, according to one embodiment of the present disclosure.

In comparison, FIG. 12B illustrates a printhead layout 650, according to one embodiment of the present disclosure. The printhead layout 650 includes at least two adjacent columns 652, 654 of nozzles 660 in which a top nozzle 662 of each column 652, 654 have no (or minimal) vertical offset from each other. Printhead layout 650 provides one example of a printhead layout used to employ the embodiments described in association with FIGS. 5A-11, in which edge roughness is smoothed via altering the firing order by using different starting nozzles for adjacent columns of nozzles that use the same rotation of nozzles in the firing order. Accordingly, FIG. 12B illustrates the offset between the starting nozzle 667 of the firing order of column 652 and the starting nozzle 668 of the firing order of column 654. In one aspect, FIG. 12B illustrates choosing different starting nozzles between the firing order of adjacent columns of nozzles effectively produces a vertical offset functionality (represented by distance D1) similar to the physical vertical offset provided in printhead layout 600 illustrated in FIG. 12A.

In another embodiment, a roughness pattern (in a vertical edge of a printable element) is hidden via using the printhead layout 650 illustrated in FIG. 12B (in which the columns do not have any physical vertical offset), except with each column 652, 654 of nozzles 660 having a different firing order rotation. In other words, the nozzles of one respective column 652 are fired in a different order than the nozzles of the other respective column 654. By doing so, a virtual vertical offset is effectively introduced which produces the substantially the same effect as the physical vertical offset illustrated in FIG. 12A, thereby causing a redistribution of maximum dot placement errors among minimum dot placement errors to hide an otherwise rough pattern in a vertical edge of a printable element. In one aspect, the different firing orders are selected after identifying the shape of the roughness pattern of the vertical edge of the printable element and then selecting the different firing orders to cause the desired redistribution of the maximum dot placement errors and the minimum dot placement errors.

It is also understood that these embodiments of altering the firing order of adjacent columns of nozzles are not limited to two columns of nozzles, but are applicable to three or more columns of nozzles.

Embodiments of the present disclosure enable the use of non-staggered nozzle patterns, thereby simplifying the design, manufacture, and cost of producing printheads. At the same time, by altering a firing order (by applying an offset in the starting nozzle of the respective firing orders, by using different firing orders, or using a physical offset) between adjacent columns of nozzles, embodiments of the present disclosure enable the use of existing firing orders associated with previously staggered nozzles. Accordingly, the introduction of high spatial frequency noise to a previously rough vertical edge of a black text element, such as character or symbol, hides the roughness because the high spatial frequency noise is provided on a scale not readily detectable during normal reading. In this way, the roughness is blended out of sight.

Embodiments of the present disclosure enable the elimination of a staggered nozzle pattern, which allows for smaller printheads, faster firing frequencies, longer resistor life, and simplified fluidic design permitting a quicker path to market.

Components of the embodiments of the present disclosure may also reside in software on one or more computer-readable mediums. The term computer-readable medium as used herein is defined to include any kind of memory, volatile or non-volatile (e.g., floppy disks, hard disks, CD-ROMs, flash memory, read-only memory (ROM), and random access memory (RAM)). In one embodiment, a printhead manager, including a firing module, as described herein run on a controller, computer, appliance or other device having an operating system which can support one or more applications. The operating system is stored in memory and executes on a processor.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that the claimed subject matter be limited by the claims and the equivalents thereof.

What is claimed is:

1. A method of printing comprising:

providing a printhead including at least two adjacent columns of nozzles, with the nozzles of each respective column arranged in a non-staggered pattern relative to a scan axis direction;

generating, via a controller of the printhead, a printable element based on a non-simultaneous firing order for the nozzles of each respective column;

identifying a roughness pattern in a vertical edge of the printable element; and hiding the roughness pattern of the vertical edge of the printable element by altering the firing order to differ between the at least two respective adjacent columns of nozzles.

2. The method of claim 1 wherein hiding the roughness pattern by altering the firing order comprises:

introducing a physical offset along a vertical orientation, generally perpendicular to the scan axis direction, between the at least two respective adjacent columns of nozzles.

3. The method of claim 1 wherein hiding the roughness pattern by altering the firing order comprises:

modifying a sequence of the firing order of at least one column of the at least two respective adjacent columns to differ from a sequence of the firing order of the remaining respective columns of nozzles.

4. The method of claim 1 wherein hiding the roughness pattern by altering the firing order sequence comprises:

offsetting a starting nozzle of the firing order between the at least two respective adjacent columns of nozzles.

5. The method of claim 1 wherein the roughness pattern corresponds to a dot placement error pattern of maximum dot placement errors and minimum dot placement errors in the scan axis direction and wherein hiding the roughness pattern comprises re-distributing the maximum dot placement errors among the minimum dot placement errors.

6. The method of claim 5 wherein the roughness pattern comprises at least one of a sine wave and a zigzag shape.

7. The method of claim 5, comprising:

identifying, within the vertical edge of the printable element, the maximum dot placement errors and the minimum dot placement errors associated with the firing order of the respective at least two columns of nozzles; and repositioning and intermixing the maximum dot placement errors among the minimum dot placement errors via at least one of:

interposing an offset between a starting nozzle of the firing order of the at least two adjacent columns wherein a sequence of the firing order of the respective columns is the same;

introducing a vertically oriented physical offset between the at least two adjacent columns of nozzles; and modifying the firing order of at least one column of the respective at least two columns of nozzles to cause a sequence of the firing order of each respective columns of nozzles to differ from each other.

8. The method of claim 1 wherein the printable element is printed at a resolution of no greater than 1200 dpi and the printable element comprises at least one of a text character, symbol, numeral, or graphic and excludes a photo image.

9. The method of claim 1, comprising:

arranging the printhead to be in a non-slanted orientation relative to the scan axis direction.

10. A computer readable medium having computer-executable instructions for performing a method of printing text, the method comprising:

providing a printhead including at least two adjacent columns of nozzles, with the nozzles of each respective column arranged in a non-staggered pattern;

generating, via a controller of the printhead, a printable element based on a first non-simultaneous firing order sequence for the nozzles of each respective column;

identifying a roughness pattern in a vertical edge of the printable black text element; and hiding the roughness pattern of the vertical edge of the printable black text element by altering the firing order for at least one column of the respective at least two adjacent columns of nozzles.

11. The medium of claim 10, comprising:

identifying, within the vertical edge of the printable element, the maximum dot placement errors and the minimum dot placement errors associated with the firing order of the respective at least two columns of nozzles; and repositioning and intermixing the maximum dot placement errors among the minimum dot placement errors via at least one of:

interposing an offset between a starting nozzle of the firing order of the at least two adjacent columns wherein a sequence of the firing order of the respective columns is the same; and modifying the firing order of at least one of the respective at least two columns to cause a sequence of the firing order of each respective column of nozzles to differ from each other.

12. A printhead manager comprising:

a firing order module configured to define a first firing rotation of a first column of non-staggered nozzles and a second firing rotation of a second column of non-staggered nozzles, wherein each respective first and second firing rotation is non-sequential and non-simultaneous and wherein the respective first and second firing rotations enable printing a low resolution, non-image element, the non-image element including a vertical edge roughness; and an offset module configured to cause a decrease in the vertical edge roughness via establishing an offset between the first firing rotation and the second firing rotation, wherein the offset causes intermixing of maximum dot placement errors and minimum dot placement errors associated with the respective first and second firing rotations.

13. The printhead manager of claim 12 wherein the offset module includes a pattern module configured to identify a repeating shape within the vertical edge roughness associated with maximum dot placement errors and with minimum dot placement errors of the non-image element.

14. The printhead manager of claim 12 wherein the offset comprises a first offset between a starting nozzle of the first firing rotation of a first column of nozzles and a starting nozzle of the second firing rotation of a second column of nozzles and a second offset between the starting nozzle of the first firing rotation and the staffing nozzle of a third firing rotation of third column of nozzles, the value of the second offset being different than the first offset.

15. The printhead manager of claim 12 wherein the offset is established via modifying the first firing rotation to differ from the second firing rotation.

16. A printhead manager comprising:

means for producing, via a non-simultaneous and non-sequential firing order, a printable non-image element; and means for obscuring a roughness pattern in a vertical edge of the non-image element, wherein the means for obscuring comprises a nozzle firing module configured to blend a high spatial frequency pattern with the roughness pattern of the vertical edge of the non-image element.

17. The printhead manager of claim 16 wherein the nozzle firing module comprises an offset module configured to provide at least one of:

an offset between a starting nozzle of the firing order of each of the at least two adjacent columns of nozzles; and a firing order variation causing the firing order of the respective at least two adjacent columns to differ from each other.

18. The printhead manager of claim 17 wherein the nozzle firing module comprises a simulation module configured to enable visually identifying the roughness pattern of the vertical edge of the non-image element before and after application of the offset.

19. The printhead manager of claim 17 wherein the means for producing is configured to print the non-image element via a print mode resolution and a printhead associated with the printhead manager includes a stagger substantially different than the print mode resolution.

* * * * *

UNITED STATES PATENT AND TRADEMARK OFFICE

CERTIFICATE OF CORRECTION

PATENT NO. : 7,568,777 B2
APPLICATION NO. : 11/830127
DATED : August 4, 2009
INVENTOR(S) : Garrett E. Clark It is certified that error appears in the above-identified patent and that said Letters Patent is hereby corrected as shown below:

In column 16, line 55, in Claim 14, delete "staffing" and insert -- starting --, therefor.

Signed and Sealed this

Sixteenth Day of March, 2010

David J. Kappos

David J. Kappos
*Director of the United States Patent and Trademark Office*